US007106990B2

(12) United States Patent
Murano et al.

(10) Patent No.: US 7,106,990 B2
(45) Date of Patent: Sep. 12, 2006

(54) IMAGE FORMING APPARATUS

(75) Inventors: Junichi Murano, Sayama (JP); Kazuyoshi Matsumoto, Tokyo (JP); Osamu Takashima, Tokyo (JP); Katsunori Shoji, Chigasaki (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/938,572

(22) Filed: Sep. 13, 2004

(65) Prior Publication Data

US 2005/0095032 A1 May 5, 2005

(30) Foreign Application Priority Data

Sep. 18, 2003 (JP) ..... 2003-326973

(51) Int. Cl.
*G03G 15/00* (2006.01)
*G03G 21/16* (2006.01)

(52) U.S. Cl. ..... 399/108; 399/107; 399/110

(58) Field of Classification Search ..... 399/107, 399/110, 108, 347, 358
See application file for complete search history.

(56) References Cited

U.S. PATENT DOCUMENTS 3,988,802 A * 11/1976 Bruni et al. ..... 16/429
4,748,481 A * 5/1988 Kunihiro ..... 355/133
4,803,593 A 2/1989 Matsumoto et al.
5,594,539 A 1/1997 Murano et al.
5,819,139 A * 10/1998 Harlan et al. ..... 399/110
5,913,095 A 6/1999 Takashima et al.
6,725,991 B1 4/2004 Murano et al.
6,779,975 B1 8/2004 Takashima et al.
6,788,321 B1 * 9/2004 Araki et al. ..... 347/138
6,834,172 B1 * 12/2004 Tomita ..... 399/108

FOREIGN PATENT DOCUMENTS

JP 08190332 A * 7/1996
JP 08305101 A * 11/1996
JP 09050223 A * 2/1997
JP 09212064 A * 8/1997
JP 10020601 A * 1/1998
JP 11015225 A * 1/1999

* cited by examiner

*Primary Examiner*—David M. Gray
*Assistant Examiner*—Joseph S. Wong
(74) *Attorney, Agent, or Firm*—Oblon, Spivak, McClelland, Maier & Neustadt, P.C.

(57) ABSTRACT

The image forming apparatus is equipped with a straight handle that can be pushed into and pulled out of an outer wall through a hole provided to the outer wall, and has a protruding component on the outer wall in the vicinity and next to the hole. The handle is constituted such that when pulled outward from the hole, the handle protrudes horizontally at a specific angle away from the protruding component.

5 Claims, 4 Drawing Sheets

IMAGE FORMING APPARATUS

BACKGROUND OF THE INVENTION

1. Field of the Invention

The present invention relates to an image forming apparatus, such as a copier, printer, or fax machine, having a handle that is supported so as to be able to go in and out of a hole provided in an outer wall, and designed so that the handle can be firmly grasped and used effectively despite the presence of an obstruction near the handle, so that the apparatus, which is a heavy object, can be transported or moved more easily.

2. Description of the Related Art

Some conventional printers, fax machines, and other such image forming apparatus are designed such that a retractable handle is provided in a hole made in an outer wall of the apparatus main body so that a person can lift the apparatus by grasping a place on the outer wall when the apparatus is to be moved. With an image forming apparatus having a stowage configuration such as this, a system in which the handle is slidably stowed within the apparatus main body is usually used for the sake of lower cost and a simpler mechanism.

With a system such as this, not only must the handle bear a heavy weight during transport, and be able to slide over a high-strength frame located on the inside of the outer wall, but the handle must also be disposed at a location that will afford a good weight balance when the handle is grasped and the apparatus is moved, so the handle can only be disposed in a limited number of locations on the apparatus main body.

Accordingly, it is difficult to dispose the handle in a location that would afford a worker an easy grip, which means that the worker must perform the work while grasping the handle in an awkward posture.

SUMMARY OF THE INVENTION

The present invention was conceived in light of the above situation, and provides an image forming apparatus having a handle that is supported so as to be able to go in and out of a hole provided in an outer wall, and designed so that the handle is supported by a frame with adequate strength and can be grasped by a worker in a comfortable posture, so that the apparatus, which is a heavy object, can be transported or moved more easily.

In accordance with the present invention, there is provided:

(1) An image forming apparatus equipped with a handle that can be pushed into and pulled out of an outer wall through a hole provided in the outer wall, and having a protruding component on the outer wall in the vicinity and next to the hole, wherein the handle is constituted such that when pulled outward from the hole, the handle protrudes horizontally at a specific angle away from the protruding component.

(2) The image forming apparatus according to (1) above, wherein the handle is constituted such that in a state of having been pulled out from the hole, the handle can tilt up and down within a specific range within the hole.

(3) The image forming apparatus according to (2) above, wherein the portion of the apparatus, which abuts on the rear end of the handle and is subjected to a load when the handle that has been pulled out from the hole is grasped and an upward load is applied, is in the vicinity of the frame of the apparatus main body.

(4) The image forming apparatus according to (3) above, wherein a portion that keeps the handle from falling out when pulled out is not formed into a vertical plate portion but instead forms a horizontal plate portion of the handle.

(5) The image forming apparatus according to (1) above, wherein the portion of the apparatus, which abuts on the rear end of the handle and is subjected to a load when the handle that has been pulled out from the hole is grasped and an upward load is applied, is located in the vicinity of the frame of the apparatus main body.

(6) The image forming apparatus according to (5) above, wherein a portion that keeps the handle from falling out when pulled out is not formed into a vertical plate portion but instead forms a horizontal plate portion of the handle.

(7) The image forming apparatus according to (1) above, wherein a portion that keeps the handle from falling out when pulled out is not formed into a vertical plate portion but instead forms a horizontal plate portion of the handle.

BRIEF DESCRIPTION OF THE DRAWINGS

The above and other objects, features, and advantages of the present invention will become more apparent from the following detailed description taken with the accompanying drawings in which.

DESCRIPTION OF THE PREFERRED EMBODIMENTS

Before the present invention is described, prior art and its related problems will be described.

Figure 1:
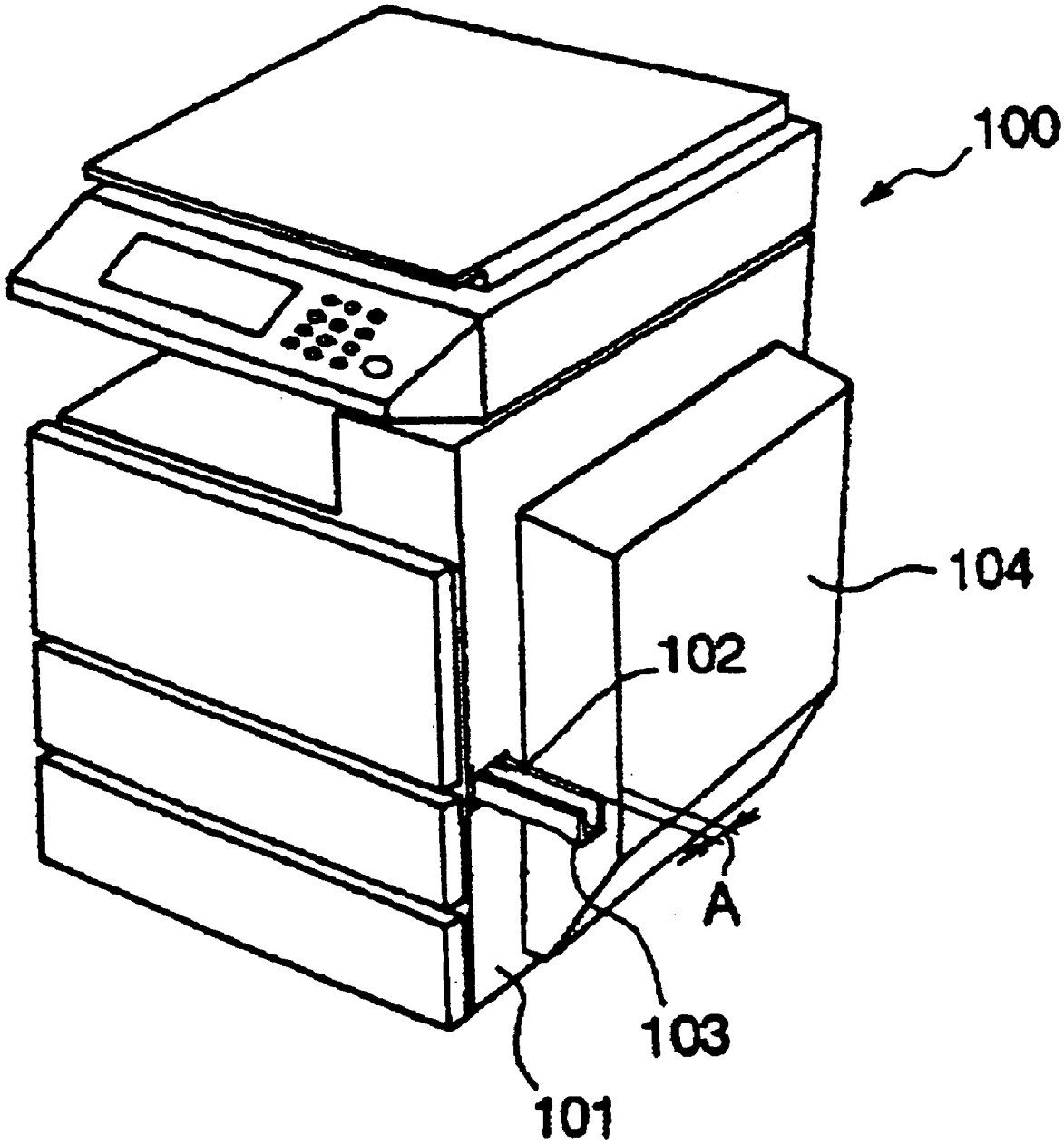
FIG. 1 PRIOR ART
FIG. 1 is an overall oblique view of an image forming apparatus with a conventional handle configuration.

FIG. 1 illustrates the configuration of the handle in a conventional image forming apparatus. As shown, a hole 102 is made at a suitable location in an outer wall 101 of an image forming apparatus 100. A handle 103 made of a metal material can be pulled out of and pushed into this hole 102. The direction in which the handle 103 protrudes is horizontal and perpendicular to the outer face of the outer wall 101.

Because the handle 103 must bear a heavy weight during transport, not only must it be able to slide over a high-strength frame located on the inside of the outer wall, but the handle must also be disposed at a location that will afford a good weight balance when the handle is grasped and the apparatus moved, so the handle can only be disposed in a limited number of locations on the apparatus main body. Because the disposition of the handle is thus limited to a relatively narrow range of suitable places, it is frequently the case that an obstruction 104, consisting of an optional unit such as a double-side printing unit, is present just to the side of the hole 102. In such a case, the layout restrictions imposed by this obstruction 104 result in an extremely narrow gap A between the extended handle 103 and the obstruction 104, which makes it difficult for a worker to get a good grip, and requires that the lifting be done in an awkward posture.

If the handle were provided at a location that would afford an easy grip and avoid the obstruction 104, it would be impossible to attach the handle to the frame, so the handle would not be strong enough and a special reinforcing member would have to be added.

An embodiment of the present invention that solves the above problems encountered with prior art will now be described in detail through reference to the drawings.

Figure 2A:
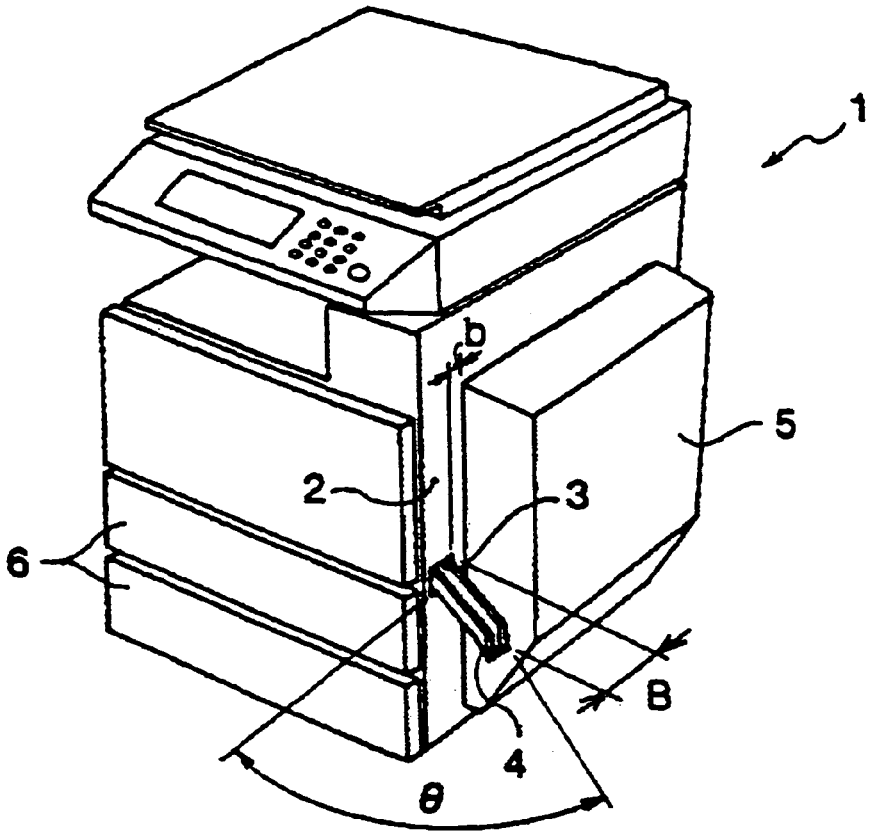
FIG. 2A is an overall oblique view of an image forming apparatus with the handle configuration pertaining to an embodiment of the present invention.
Figure 2B:
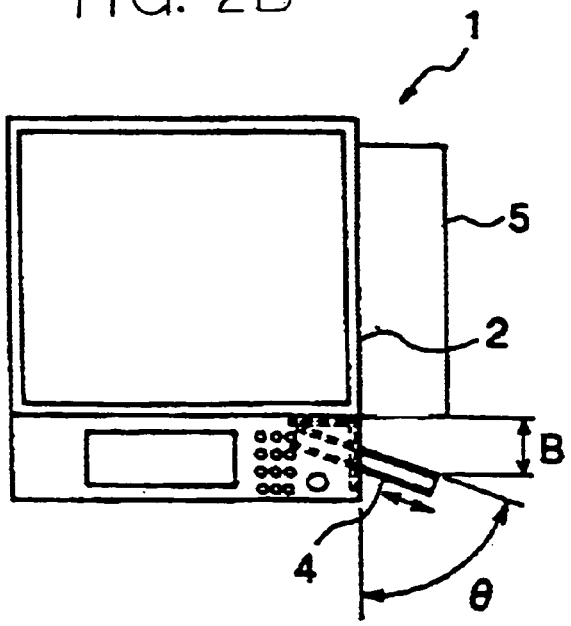
FIG. 2B is a plan view thereof.

As shown in FIGS. 2A and 2B, the image forming apparatus 1 pertaining to this embodiment has a hole 3 at the front part of an outer wall (housing) 2 (i.e., a side wall) of the apparatus main body. A straight metal handle 4 is supported such that it can move in and out of the apparatus through this hole 3. A protruding component 5 consisting of an optional unit such as a double-side printing unit is disposed just to one side of the hole 3. Since only a slight gap b is present between the hole 3 and the front part of the protruding component 5, it is impossible to ensure enough space for a worker to insert a hand if the handle 4 is pulled out perpendicular to the outer wall 2.

Figure 3:
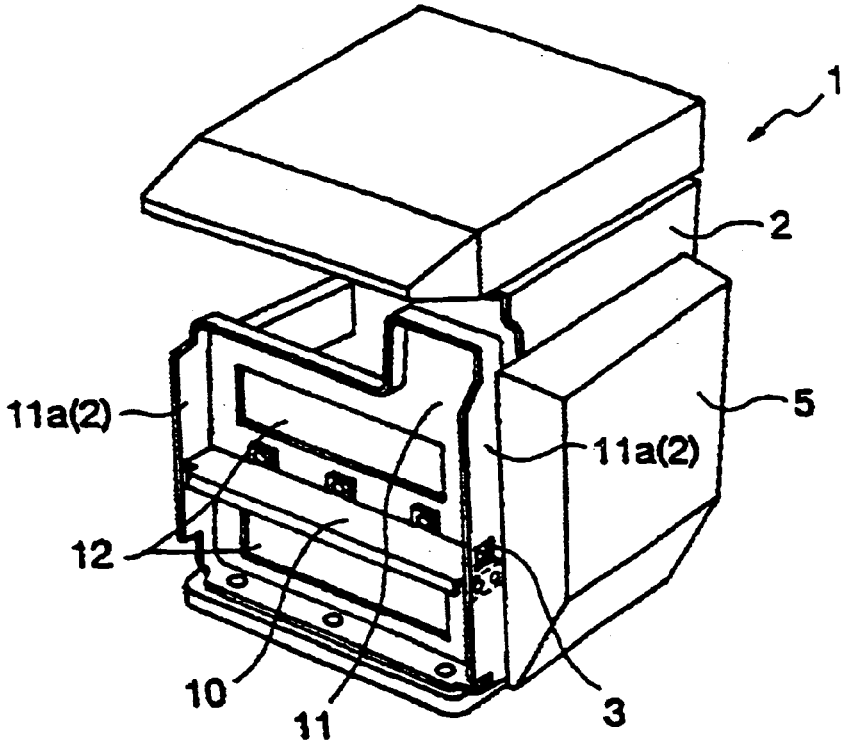
FIG. 3 is an oblique view showing in cross section the internal configuration of this image forming apparatus.
Figure 4:
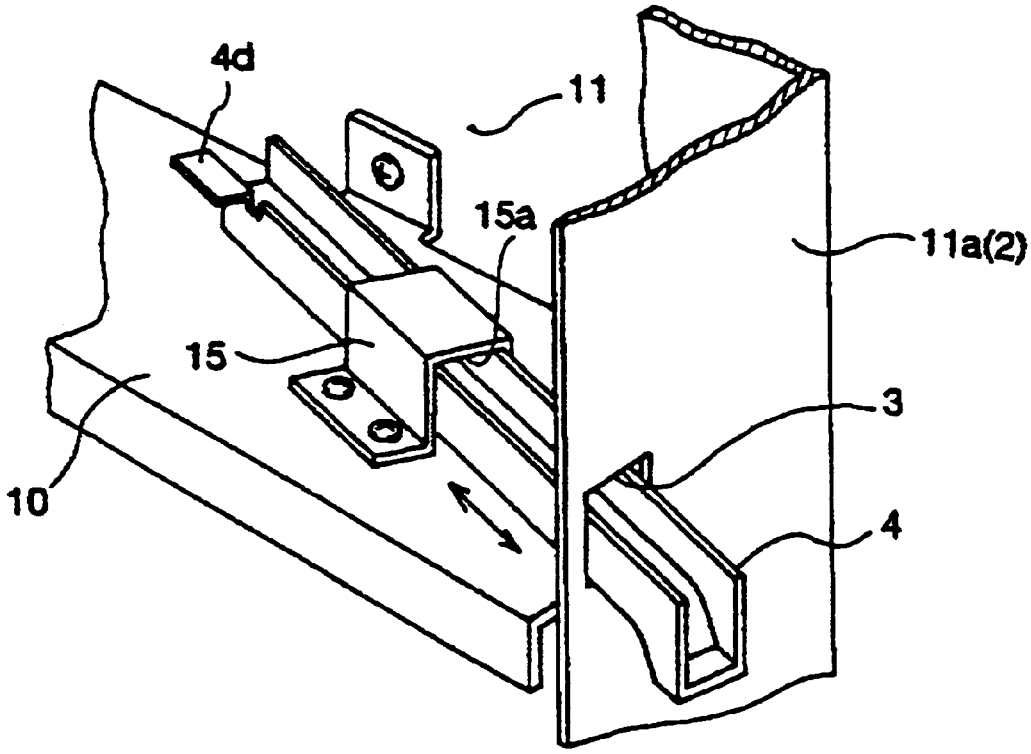
FIG. 4 is an oblique view of the configuration of the main components thereof.

On the other hand, if the handle 4 is supported by a frame 10 that is a strong internal component, as shown in FIGS. 3 and 4, the only place the hole 3 can be formed is a very small area around this frame.

In view of this, this embodiment is configured such that when the handle 4 has been pulled out from the hole 3, the entire handle 4 slidably protrudes horizontally at a specific inclination angle θ away from the protruding component 5 is viewed from above the image forming apparatus. The result of this configuration is that a space B formed between the distal end of the extended handle 4 and the front end of the protruding component 5 is enough space for a person to insert a hand.

Next, FIG. 3 shows the state when the front housing panel has been removed from the image forming apparatus 1. A front panel 11 that constitutes a frame is located on the inside of the front housing panel, and an opening 12 for supporting the pull-out paper tray 6 shown in FIG. 2A is formed in the front panel 11. A horizontal, flat frame 10, which is a high-strength component, is fastened by screws or the like to the front of the front panel 11 (part of the outer wall 2) and to left and right side panels 11*a*. As shown in FIG. 4, a bracket 15 is fastened diagonally on the frame 10, and the handle 4, produced by forming a sheet of metal into the required straight shape, is retractably supported within a support hole 15*a* in the bracket 15. The hole 3 is made in the outer wall 2 (side panel 11*a*) at a location corresponding to the distal end of the handle 4. In other words, the handle 4 can be moved in and out of the hole 3 by extending and retracting the handle along the bracket 15.

Figure 5:
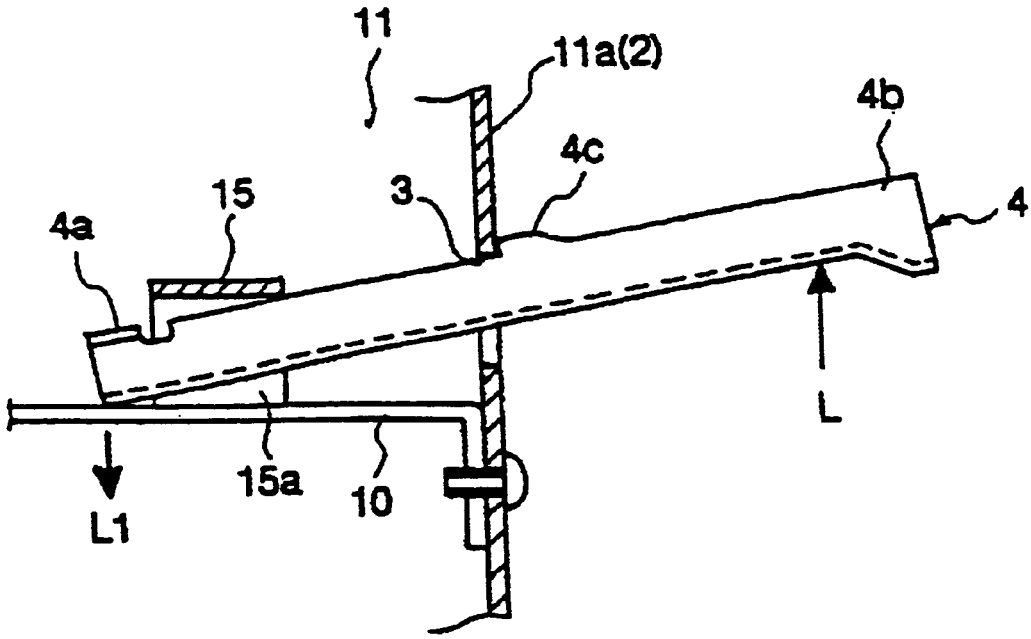
FIG. 5 is a vertical cross section illustrating these main components a state in which the handle has been pulled out and lifted.

The size of the support hole 15*a* of the bracket 15 is set to be large enough that the handle 4 can be tilted up and down as discussed below. Therefore, when the apparatus is moved by a service person, salesperson, or user, the handle 4 is pulled out from the apparatus main body as shown in FIGS. 2A and 2B. When the handle 4 has been pulled out, as shown in FIG. 5, the rear end 4*a* of the handle 4 catches on the upper surface of the frame 10 or on the edge of the support hole 15*a* of the bracket, so that the handle cannot be pulled out any farther. When a worker grasps the handle 4, a load L is applied upward to the grasped side (distal end side) 4*a* of the handle 4, so a load L1 is applied to the frame 10, with the fulcrum at the left and right side panels 11*a* in which the hole 3 is formed.

At this point, the handle 4 is disposed at a specific inclination angle θ (θ<90 degrees) with respect to the front panel 11, with the result being that the rear end 4*a* of the handle 4 is located nearer the front panel 11, which provides a strength advantage when the handle is subjected to a load.

As shown in FIG. 5, in a state in which the handle 4 has been pulled out and lifted up, a protrusion 4*c* provided on the upper edge in the middle part of the handle 4 engages with the fulcrum portion of the side panel 11*a* (the upper edge of the hole 3) when this protrusion 4*c* moves outside of the hole 3, and this prevents the handle 4 from going back into the main body while the handle 4 is gripped.

A bent portion 4*d*, in the form of a horizontal tab bent laterally, is located as shown in FIG. 4 on the top edge of the rear end 4*a* of the handle 4. This bent portion 4*d* is used to keep the handle from coming out of the bracket hole 15*a*.

Figure 6:
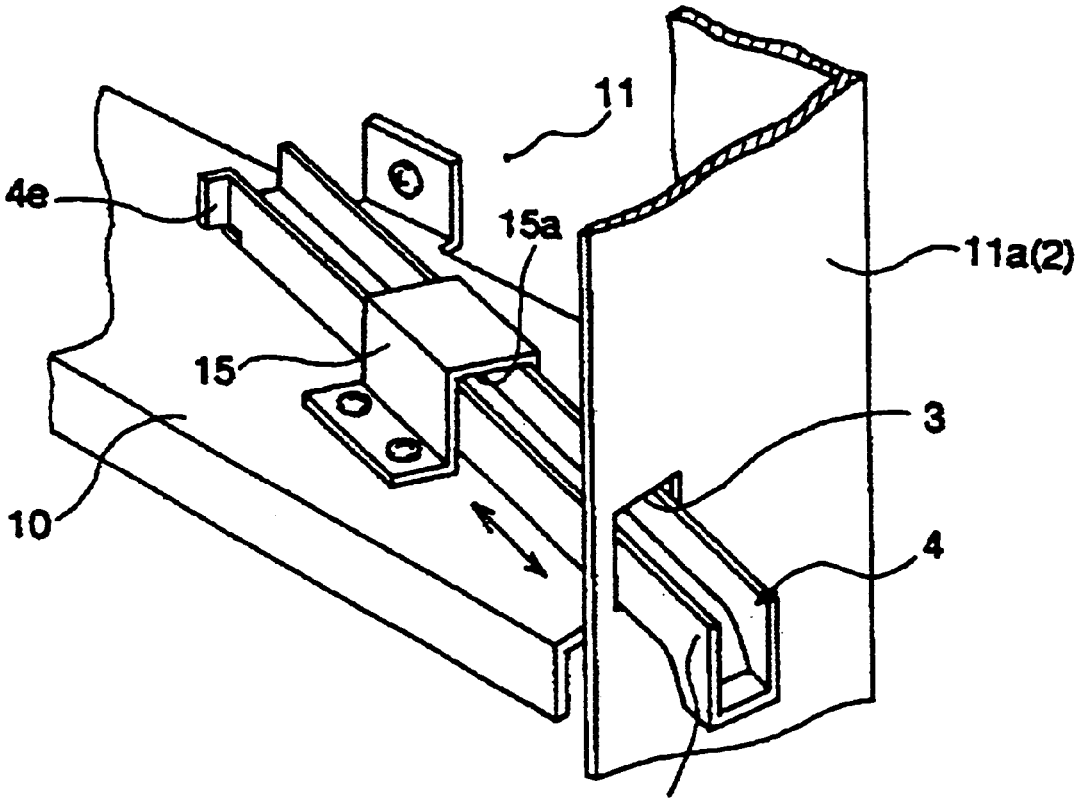
FIG. 6 is an oblique view of the configuration in an example of modifying part of these main components.

It is disadvantageous in terms of strength for the handle rear end 4*a* to be made into a vertical tab 4*e* as shown in FIG. 6.

Various modifications will become possible for those skilled in the art after receiving the teachings of the present disclosure without departing from the scope thereof.

What is claimed is:

1. An image forming apparatus having a side wall, which comprises:

a handle that can be pushed into and pulled out of said side wall of the image forming apparatus, the handle including a horizontal plate portion and a protrusion on an upper portion of the handle that engages the image forming apparatus when the handle is pulled out of the side wall and is in a lifted position to prevent the handle from being pushed into the image forming apparatus;

a protruding component on the side wall, said protruding component being located in the vicinity of and next to said handle; and a bracket configured to retain the handle by engaging with the horizontal plate portion of the handle;

wherein the handle protrudes horizontally at a specific angle of inclination away from said protruding component and the handle is angled with respect to the side wall at an angle of less than 90° as viewed from above the image forming apparatus.

2. The image forming apparatus according to claim 1, wherein the handle is tiltable in a vertical direction within a specific range when the handle is in a pulled out position from the side wall.

3. The image forming apparatus according to claim 2, wherein a portion of the image forming apparatus which abuts on a rear end of the handle and is subjected to a load when the handle is in the pulled out position from the side wall and is grasped and an upward load is applied is in the vicinity of a corner portion of a main body of the image forming apparatus as viewed from above the image forming apparatus.

4. The image forming apparatus according to claim 3, wherein a rear portion of the handle is positioned nearer a front wall than a front portion of the handle.

5. The image forming apparatus according to claim 1, wherein said portion of the image forming apparatus which abuts on the rear end of the handle and is subjected to a load when the handle is in the pulled out position from the side wall and is grasped and an upward load is applied is positioned in the vicinity of the frame of the main body of the image forming apparatus.

* * * * *